US005918673A

United States Patent [19]

Hawkins et al.

[11] Patent Number: 5,918,673

[45] Date of Patent: Jul. 6, 1999

[54] METHOD AND MULTI-PURPOSE APPARATUS FOR DISPENSING AND CIRCULATING FLUID IN WELLBORE CASING

[75] Inventors: Samuel P. Hawkins, Mineral Wells, Tex.; Donald E. Mosing, Lafayette, La.; David L. Sipos, Youngsville, La.; Keith T. Lutgring; Burney J. Latiolais, Jr., both of Lafayette, La.

[73] Assignee: Frank's International, Inc., Houston, Tex.

[21] Appl. No.: 08/850,496

[22] Filed: May 2, 1997

Related U.S. Application Data

[63] Continuation-in-part of application No. 08/726,112, Oct. 4, 1996, Pat. No. 5,735,348.

[51] Int. Cl.[6] ..... E21B 33/05

[52] U.S. Cl. ..... 166/285; 166/177.4

[58] Field of Search ..... 166/285, 177.4, 166/334.4, 70

[56] References Cited

U.S. PATENT DOCUMENTS

| | | | |
|---|---|---|---|
| 4,076,083 | 2/1978 | Sizer | 175/65 |
| 4,655,286 | 4/1987 | Wood | 166/285 |
| 4,913,231 | 4/1990 | Muller et al. | 166/250 |
| 4,997,042 | 3/1991 | Jordan et al. | 166/379 |
| 5,152,554 | 10/1992 | La Fleur et al. | 285/88 |
| 5,191,939 | 3/1993 | Stokley | 166/379 |
| 5,236,035 | 8/1993 | Brisco et al. | 166/285 |
| 5,435,390 | 7/1995 | Baugh et al. | 166/285 |
| 5,443,122 | 8/1995 | Brisco | 166/285 |
| 5,501,280 | 3/1996 | Brisco | 166/373 |
| 5,553,667 | 9/1996 | Budde et al. | 166/70 |
| 5,584,343 | 12/1996 | Coone | 166/387 |
| 5,641,021 | 6/1997 | Murray et al. | 166/177.4 |
| 5,660,234 | 8/1997 | Hebert et al. | 166/285 |

FOREIGN PATENT DOCUMENTS 2275486 9/1992 United Kingdom .

OTHER PUBLICATIONS

Technical Article, The Brief, Jun. 1995, Franks FC–1 Circulation Packer.

Lafleur Petroleum Services Inc., Autoseal Circulating Head.

B.J. Hughes Brochure, Subsea Cementing Systems, p. 28.

B & W Incorporated Brochure, "B & W Rotating Surface Casing Cementing Method", p. 502.

B & W Incorporated Brochure, "Gravel Compaction" pp. 509–510.

(List continued on next page.)

*Primary Examiner*—William P. Neuder

*Attorney, Agent, or Firm*—Matthews, Joseph, Shaddox & Mason; Dwayne L. Mason

[57] ABSTRACT

A multi-functional apparatus and method for drilling fluid and cementing operations to set casing in a wellbore for use on either top drive or rotary type rigs. The apparatus and method includes a fill-up and circulating tool, a cementing head assembly, and a wiper plug assembly. The fill-up and circulating tool comprises a mandrel with a packer cup fixedly attached to a sliding sleeve disposed about the outside diameter of the mandrel. The cementing head and wiper plug assemblies are useable on any fill-up and circulating tool capable of being inserted into a casing. To fill the casing, the assembly is lowered from the rig such that a portion of the fill-up tool is inserted into the casing, the pumps are then actuated to flow fluid into the casing. To circulate fluid, the tool is lower further such that the packer cup sealingly engages the inside diameter of the casing to allow fluid to flow through the casing, into the wellbore, and back to the fluid pumps. To cement the casing, the cement pump and hose assembly is connected to the cementing head to allow cement to be pumped through the fill-up and circulating tool and into the casing string. A cement plug assembly comprising a plurality of wiper plugs is connected to the outlet of the fill-up and circulating tool. The wiper plugs are then released at a predetermined time during the cementing process to provide a positive seal at the bottom of the casing string.

47 Claims, 7 Drawing Sheets

OTHER PUBLICATIONS

TAM International Brochure, "TAM Casing Circulating Packer", 1991.
Frank's Casing Crew & Rental Tools, Inc. Brochure, "HiTop Model FC–Fill–Up Circulation Tool".
Frank's Casing Crew & Rental Tools, Inc. Technical Manual, HiTop Oil Tools, Mar. 2, 1995, Rev A.
Frank's Casing Crew & Rental Tools, Inc. Technical Manual, "HiTop Oil Tool", Feb. 28, 1995, Rev A.
TAM International article, Running Procedure for 11" & 7" O.D. Casing Circulating Packer Fill–Up, 13 3/8" & 9 5/8" Casing, Mar. 9, 1993, pp. 1–2.
LaFleur Petroleum Services, Inc. Procedural Brochure, "Autoseal Circulating Head", Apr. 25, 1995, pp. 1–10.
Wassenborg, M.; "Franks FC–1 Circulation Packer Washes 13 5/8" Casing to Bottom", The Brief, Jun. '95.
Halliburton Services, Technical Drawing #3481.
Davis–Lynch, Equipment Catalogue #11, 1993, pp. 866–895.
B & W Incorporated Brochure, "Rotating Surface Casing Cementing Method"; and "Gravel Compaction Operation & Apparatus", pp. 509–510.
Oil & Gas Journal, Halliburton, p. 12.
Composite Catalog 1965, "Brown Hyflo Liner Packers" p. 944.
PBL Drilling Tools, Ltd. Brochure Hydro Mechanical Casing Circulator Composite Catalog, "Brown Duo–Pak Packer", p. 919.
Composite Catalog 1985, "Waterflood Systems" p. 701.
Composite Catalog 1985, "Service Tools", p. 296.
Composite Catalog 37$^{th}$ Revision 1986–87 in 4 Volumes, "Bowen Swivels".
PBL Drilling Tools Ltd., "Hydromechanical Casing Circulator".
Wepco Brochure, "Hydraulically Operated Circulation Head".

METHOD AND MULTI-PURPOSE APPARATUS FOR DISPENSING AND CIRCULATING FLUID IN WELLBORE CASING

This is a continuation-in-part application of application Ser. No. 08/726,112, filed Oct. 4, 1996, now U.S. Pat. No. 5,735,348, entitled Method & Multi-Purpose Apparatus for Dispensing & Circulating Fluid in Wellbore Casing.

FIELD OF INVENTION

This invention relates generally to equipment used in the drilling and completion of subterranean wells, and more specifically to the filling and circulating of drilling fluids in a casing string as well as pumping cement into the casing to set the casing within the wellbore.

BACKGROUND

The process of drilling subterranean wells to recover oil and gas from reservoirs, consists of boring a hole in the earth down to the petroleum accumulation and installing pipe from the reservoir to the surface. Casing is a protective pipe liner within the wellbore that is cemented in place to insure a pressure-tight connection to the oil and gas reservoir. The casing is run a single joint at a time as it is lowered into the wellbore. On occasion, the casing becomes stuck and is unable to be lowered into the wellbore. When this occurs, load must be added to the casing string to force the casing into the wellbore, or drilling fluid must be circulated down the inside diameter of the casing and out of the casing into the annulus in order to free the casing from the wellbore. To accomplish this, it has traditionally been the case that special rigging be installed to add axial load to the casing string or to facilitate circulating the drilling fluid.

When running casing, drilling fluid is added to each section as it is run into the well. This procedure is necessary to prevent the casing from collapsing due to high pressures within the wellbore. The drilling fluid acts as a lubricant which facilitates lowering the casing within the wellbore. As each joint of casing is added to the string, drilling fluid is displaced from the wellbore. The prior art discloses hose assemblies, housings coupled to the uppermost portion of the casing, and tools suspended from the drill hook for filling the casing. These prior art devices and assemblies have been labor intensive to install, required multiple such devices for multiple casing string sizes, have not adequately minimized loss of drilling fluid, and have not been multi-purpose. Further, disengagement of the prior art devices from the inside of the casing has been problematic, resulting in damage to the tool, increased downtime, loss of drilling fluid, and injury to personnel.

The normal sequence for running casing involves suspending the casing from a top drive or non-top drive (conventional rotary rig) and lowering the casing into the wellbore, filling each joint of casing with drilling fluid. Lowering the casing into the wellbore is facilitated by alternately engaging and disengaging elevator slips and spider slips with the casing string in a stepwise fashion. Circulation of the fluid is necessary sometimes if resistance is experienced as the casing is lowered into the wellbore. In order to circulate the drilling fluid, the top of the casing must be sealed so that the casing may be pressurized with drilling fluid. Since the casing is under pressure the integrity of the seal is critical to safe operation, and to minimize the loss of the expensive drilling fluid. Once the casing reaches the bottom, circulating of the drilling fluid is again necessary to test the surface piping system, to condition the drilling fluid in the hole, and to flush out wall cake and cuttings from the hole. Circulating is continued until at least an amount of drilling fluid equal to the volume of the inside diameter of the casing has been displaced from the casing and wellbore. After the drilling fluid has been adequately circulated, the casing may be cemented in place.

On jobs which utilize a side door elevator, the casing is simply suspended from a shoulder on the elevator by the casing collar. Thus, fill-up and circulation tools with friction fit sealing elements such as packer cups, and other elastomeric friction fit devices must repeatedly be inserted and removed because of the overall length requirements of the tool. This repeated insertion and removal will, over time, result in the wearing of the elastomeric sealing element such that it will no longer automatically seal on insertion. An adjustable extension is disclosed, which allows the fill-up and circulation tool to be retracted to prevent the elastomeric seal from being inserted into the casing during the fill-up process.

Circulation alone may be insufficient at times to free a casing string from an obstruction. The prior art discloses that the fill-up and circulation tools must be rigged down in order to install tool assemblies to attach to the rig to allow the string to be rotated and reciprocated. This process requires manual labor, inherent in which is the possibility of injury or loss of life, and results in rig downtime. The potential for injury and lost rig time is a significant monetary concern in drilling operations. To eliminate this hazard and minimize lost rig time, a method and apparatus is disclosed, which allows the fill-up and circulation tool to remain rigged up while at the same time allowing the casing to be rotated and reciprocated.

After the casing has been run to the desired depth it may be cemented within the wellbore. The purpose of cementing the casing is to seal the casing to the wellbore formation. In order to cement the casing within the wellbore, the assembly to fill and circulate drilling fluid is generally removed from the drilling rig and a cementing head apparatus installed. This process is time consuming, requires significant manpower, and subjects the rig crew to potential injury when handling and installing the additional equipment flush the mud out with water prior to the cementing step. A special cementing head or plug container is installed on the top portion of the casing being held in place by the elevator. The cementing head includes connections for the discharge line of the cement pumps, and typically includes a bottom wiper plug and a top wiper plug. Since the casing and wellbore are full of drilling fluid, it is first necessary to inject a spacer fluid to segregated the drilling fluid from the cement to follow. The cementing plugs are used to wipe the inside diameter of the casing and serves to separate the drilling fluid from the cement, as the cement is carried down the casting string. Once the calculated volume of cement required to fill the annulus has been pumped, the top plug is released from the cementing head. Drilling fluid or some other suitable fluid is then pumped in behind the top plug, thus transporting both plugs and the cement contained between the plugs to an apparatus at the bottom of the casing known as a float collar. Once the bottom plug seals the bottom of the casing, the pump pressure increases, which ruptures a diaphragm in the bottom of the plug. This allows the calculated amount of cement to flow from the inside diameter of the casing to a certain level within the annulus being cemented. The annulus is the space within the wellbore between the ID of the wellbore and the OD of the casing string. When the top plug comes in contact with the bottom plug, pump pressure increases, which indicates that the cementing process has been completed. Once the pressure is lowered inside the casing, a special float collar check valve closes, which keeps cement from flowing from the outside diameter of the casing back into the inside diameter of the casing.

The prior art discloses separate devices and assemblies for (1) filling and circulating drilling fluid, and (2) cementing operations. The prior art devices for filling and circulating drilling fluid disclose a packer tube, which requires a separate activation step once the tool is positioned within the casing. The packer tubes are know in the art to be subject to malfunction due to plugging, leaks, and the like, which lead to downtime. Since each step in the well drilling process is potentially dangerous, time consuming, labor intensive and therefore expensive, there remains a need in the art to minimize any down time. There also remains a need in the art to minimize tool change out and the installation of component pieces.

Therefore, there remains a need in the drilling of subterranean wells for a tool which can be used for drilling fluid, filling and circulating, and for cementing operations.

For the foregoing reasons, there is a need for a drilling fluid filling, circulating, and cementing tool which can be installed quickly during drilling operations.

For the foregoing reasons, there is a need for a drilling fluid filling, circulating, and cementing tool which seals against the inside diameter of a casing having a self-energizing feature.

For the foregoing reasons, there is a need for a drilling fluid filling, circulating, and cementing tool which minimizes the waste of drilling fluids and allows for the controlled depressurization of the system.

For the foregoing reasons, there is a need for a drilling fluid filling, circulating, and cementing tool which may be used for every casing size.

For the foregoing reasons, there is a need for a drilling fluid filling, circulating, and cementing tool which submits additional axial loads to be added to the casing string when necessary.

For the foregoing reasons, there is a need for a drilling fluid filling, circulating, and cementing tool which is readily adjustable in length such that damage to the sealing element is minimized.

For the foregoing reasons, there is a need for a fill-up and circulation tool which that may be sealingly coupled to a casing string to allow the string to be rotated and reciprocated into the wellbore.

SUMMARY

The present invention is directed to a method and apparatus that satisfies the aforementioned needs. A drilling fluid filling, circulating and cementing tool having features of the present invention may be utilized on rigs with top drive drilling systems and conventional rotary type rig configurations. The tool may be quickly and easily installed in a top drive or a rotary type rig arrangement. The fill-up and circulating tool of the present invention includes a mandrel having a central axial bore extending therethrough. A top sub assembly which includes a series of threaded couplings and spacers may be threadedly connected to the upper end of the mandrel is included to provide proper spacing of the tool within the rigging apparatus. The lowermost portion of the mandrel may include a plurality of apertures which allows drilling fluid to flow from the bore and through the apertures during drilling fluid circulating. A lock sleeve is disposed about the outside diameter of the mandrel, and is positioned to cover the mandrel apertures during the fill-up mode of operation. A retaining spring may be disposed on the outside diameter of the mandrel to bias the lock sleeve between the fill up and circulating positions. An inverted packer cup may be fixedly connected at one end to the outside diameter of the lock sleeve. The opposite end of the cup extends radially outward and away from the outside diameter of the lock sleeve and is adapted to automatically seal against the inside diameter of the casing string when the cup is inserted into the casing. A mud saver valve and nozzle assembly may be connected to the lower end of the mandrel. The mud saver valve is actuated to the open position by increased fluid pressure from above and regulates the flow of fluid from the tool. A nozzle may be attached to the outlet of the mud saver valve to facilitate entry of the tool into the top of the casing string. This configuration is commonly used in a top drive configuration. When the tool is used in a rotary type configuration, a bayonet adapter may be installed on the inlet of the mandrel and is adapted such that fluid may be pumped directly to the tool. The tool may also be configured in a cementing and drilling fluid fill up and circulating arrangement. The cementing and drilling fluid fill up and circulating arrangement includes a cementing head assembly connected to the top of the mandrel. This configuration allows the tool to first be used for drilling fluid fill up and circulating, and then by simply removing the mud saver valve and nozzle and installing the cement wiper plug assembly common cementing operations may begin for cementing the casing in place. The fill-up and circulating tool of the present invention as well as other such tools, which are capable of being inserted into casing may be configured with a push plate assembly to transfer the weight of the rotary rig assembly and/or top drive to the casing string in order to force the string into the wellbore.

According to the method of the present invention, when the assembly is utilized for drilling fluid fill up within the casing string, the assembly is first installed on the top drive or rotary type unit and then positioned above the casing to be filled. In one embodiment, the assembly is then lowered until the hose extension is inside of the upper end of the casing string, without engaging the sealing cup with the inside of the casing. In this position the lowermost portion of the mandrel may be covered by the lock sleeve. The drilling fluid pumps may then be started, which causes the drilling fluid to flow through the assembly and upon generating sufficient fluid pressure will flow through the mud saver valve and out of the nozzle into the casing.

If a side door elevator is used to raise and lower the casing, fill-up and circulation tools which utilize packer cups or other elastomeric friction fit devices must repeatedly be inserted and removed because of the overall length requirements of the tool. A side door elevator is generally used when relatively short strings of casing are being run. The side door elevator does not have slips to engage with the casing string. The side door elevator in the open position is lowered axially over the upper end of the casing string such that the elevator shoulder is underneath the casing collar. The side door elevator is then closed and the top of the side door elevator shoulder is engaged against the bottom surface of the casing collar thereby suspending the casing string from the side door elevator. The problem associated with the use of this type of elevator is the reduced life of the packer cup or elastomeric friction fit sealing device due to wearing against the inside diameter of the casing string. Since the side door elevator is close coupled with the casing collar, due to the required spacing of the fill-up and circulating tool, the packer cup or elastomeric device is always inserted into the casing whether in the fill-up or circulation mode as each joint of casing is added to the string resulting in repeated frictional engagement with the smaller inside diameter of the casing string.

The wearing problem also occurs when the fill-up and circulation tool is in the tandem configuration. The tandem configuration comprises the use of two different sizes of packer or elastomeric devices on a single fill-up and circulation tool to allow different casing sizes to be run without stopping to re-tool. The normal spacing of the tool in the fill-up mode is to position the tool such that the packer cup is approximately 1 foot above the top of the casing string. This is not a problem when running the smaller casing since both packer cups or elastomeric devices are above the casing. However, when the larger diameter casing is run, the lower (smaller diameter) packer cup or elastomeric device is inserted into the casing string such that the upper (larger diameter) packer cup or elastomeric device is approximately 1 foot above the top of the casing string.

The present invention solves the problems associated with the repeated insertion of the packer cup or elastomeric devices into the casing string. An adjustable extension for the fill-up and circulation tool is included, which allows the tool to be retracted to a length such that the packer cups or elastomeric devices remain above and outside of the casing string during the fill-up step.

To begin the drilling fluid circulation mode, the assembly is lowered further into the casing string to cause the packer cup or elastomeric device to automatically engage and seal against the inside diameter of the casing, which generally fixes the packer cup or elastomeric device and sliding sleeve in place with respect to the casing. Further lowering of the assembly causes the mandrel to move axially downward resulting in the mandrel apertures being exposed from the sliding sleeve. On sufficient fluid pressure from the pumps, fluid exits from the tool into the casing through the apertures and through the nozzle. Continued flow of fluid through the tool and into the casing pressurizes the drilling fluid and on sufficient pressurization causes the fluid to circulated from the inside diameter of the casing into and out of the annulus to free or dislodge the casing from the wellbore.

On occasion circulation alone will not suffice to get past a down hole obstruction. Under these circumstances rotation of the casing string, and/or reciprocation of the casing string may be required to "spud" the casing into the hole. The prior art fill-up and circulation tools had to be rigged down to allow a pup piece or other similar means to be attached to the top drive rig or rotary sub to allow the string to be reciprocated and rotated past the obstruction. The rigging the fill-up and circulating tools down and up again as well as rigging up and down with the pup piece consumes considerable man-hours and rig time. The present invention offers a solution to this problem. A torque sub in combination with the fill-up and circulation tool is provided, which allows the operator to simply make-up with the coupling on the upper end of the casing with the fill-up and circulation tool remaining connected to the top drive (or rotary sub). To make-up with the casing, the spider slips are engaged against the casing fixing it in position. The elevator slips are disengaged from the casing and the top drive unit is lowered axially over the upper end of the casing to allow the threads on the torque coupling to engage with the threads on the casing coupling. The top drive is simply actuated to rotate the fill-up and circulation tool until the torque sub is threadedly connected to the casing coupling. The operator may not pick-up on the casing string to disengage the spider slips. By placing the weight of the top drive onto the casing, the entire string can then be rotated and reciprocated. The casing can then be lowered further into the well bore. Once the casing is lowered such that the elevator is in contact with the spider, the bails can be disconnected to allow the top sub to lower the casing even further into the wellbore. The spider slips are then engaged against the casing to fix it at the rig floor. The top drive is simply reversed to disengage the torque sub from the casing coupling, and the bails may be reconnected to the elevator, or if further reciprocation is necessary left uncoupled. Now another joint of casing can be picked up to make up the joint with the casing When the casing is run to the desired depth and drilling fluid filling and circulation is no longer required, the assembly may be configured for the cementing process. The drilling fluid lines are disconnected and replaced with the cement pump lines. After the drilling fluid flow is stopped, the apparatus is withdrawn from the casing to expose the mud saver valve and hose extension assembly. The mud saver valve and hose extension assembly may be simply uncoupled from the lower body of the apparatus and the cement wiper plug assembly installed. The apparatus with the cement plug assembly and cement pump lines installed is then lowered back into the casing. Once the packer cup is automatically engaged with the casing the cementing process begins. The plug release mechanism may be initiated at the appropriate times during the cementing process to release the cement wiper plugs.

The present invention may be utilized on top-drive and rotary type rigs. Unlike the prior art devices, this invention permits the same basic tool to be utilized for all casing diameters. The only difference is in the choice of packer cup assembly diameters. Thus, the necessity of having multiple tools on hand for multiple casing diameters is eliminated. This feature is much safer, saves rigging time as well as equipment rental costs for each casing installation. The same basic assembly may be used for cementing the casing within the wellbore, saving again on rigging time and equipment rental. In addition, the assembly may be configured for drilling fluid fill-up and circulating only. The prior art does not disclose a single assembly, which may be employed to fill-up and circulate drilling fluid, pressure test casing, and fill-up and circulate cement to set the casing in place.

DESCRIPTION

Figure 1:
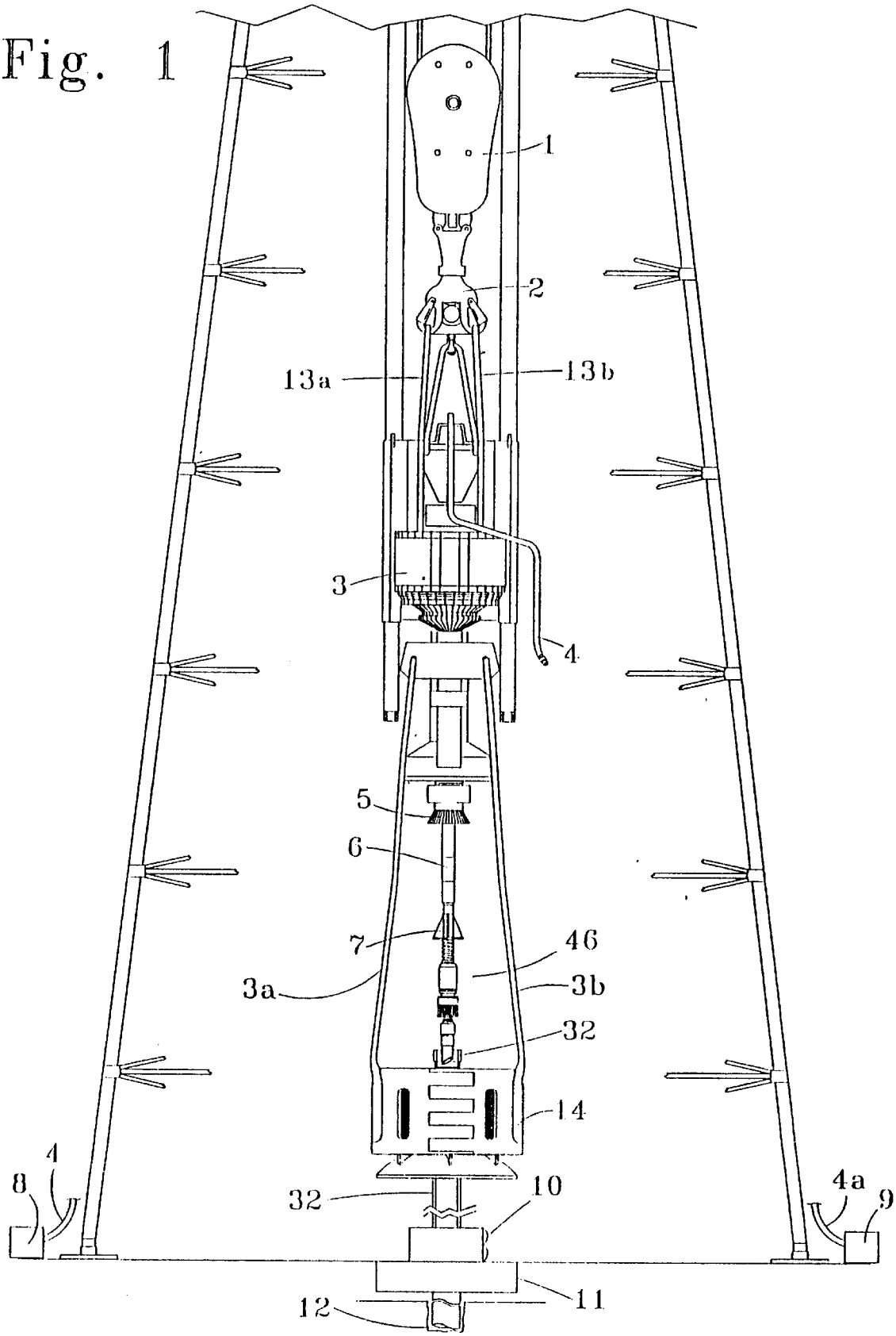
FIG. 1 Shows a top drive rig assembly in accordance with the present invention.

FIG. 1 shows a top drive drilling rig 3. FIG. 1 also shows the casing fill up and circulator tool 46 in the top drive configuration, which is more fully described below. Those skilled in the art will know that suspended from the traveling block 1 on a drilling rig is a hook 2. The top drive unit 3 is suspended from the hook 2. Pressurized fluid is delivered from the drilling fluid pumps 8 through hose 4 directly to the top drive unit 3. A top sub box connection assembly 6 is threadedly connected at one end to the top drive pin shoulder 5 to receive the fill-up and circulating tool 46. The opposite end of the top sub box connection assembly is threadedly connected to the casing fill up and circulating tool 46. A tool catch plate 7 may be fixed to the top sub box connection assembly 6 as a stop which will engages against the uppermost portion of the casing if the tool becomes disengaged from the top drive unit 3. An elevator 14 is suspended from bails 3*a* and 3*b* attached to the top drive unit 3. It should be obvious to one skilled in the art that a joint of casing 32 may be positioned under the top drive unit so as to allow the upper end of the casing to be gripped by the elevator 14, thereby inserting the fill up and circulating tool 46 partially inside of the casing 32. The casing 32, suspended from the elevator 14 may then be lowered through the rotary table slips 10 on the drilling rig floor and rotary table 11 below the rig floor and into the wellbore 12. As the casing 32 is being lowered it may be filled with drilling fluid from the fill up and circulating tool 46 the full operation of which is more fully described below. Once the casing 32 is lowered such that the elevator 14 is almost in contact with the rotary table slips 10, the slips 10 are then engaged against the casing 32 to hold it in position above the rig floor to receive the next joint of casing 32. The procedure is repeated until the entire casing string has been lowered into the wellbore 12.

Figure 2:
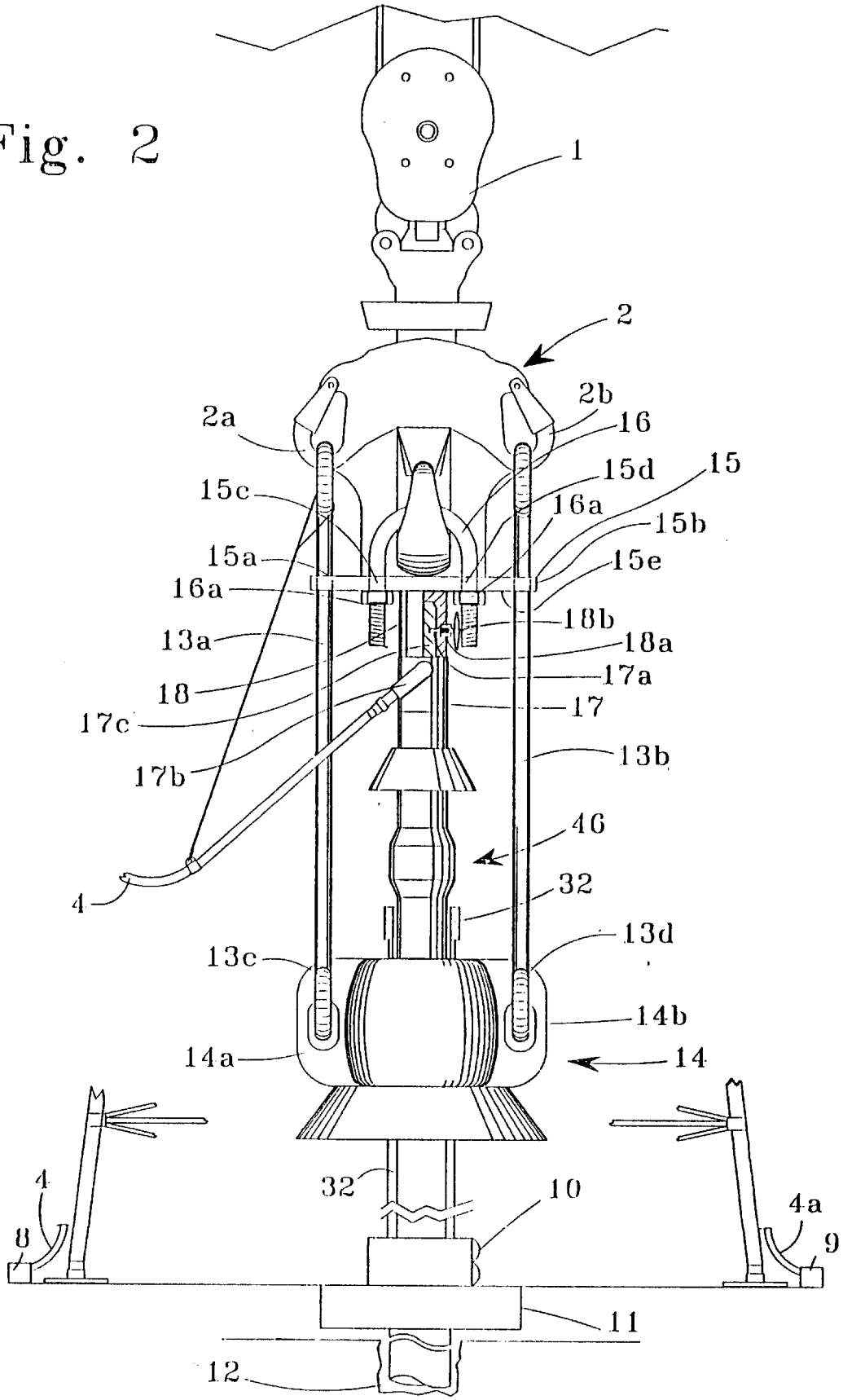
FIG. 2 Shows a conventional rotary rig assembly used in accordance with the present invention.

FIG. 2 is illustrative of a conventional drilling rig with a rotary type rig assembly with the casing circulating tool installed 46. Those skilled in the art will know that suspended from the traveling block on a rotary type rig configuration is a hook 2. The hook 2 includes two ears 2*a* and 2*b*, located on either side of the hook 2, and are used to suspend a pair of bails 13*a* and 13*b* and an elevator 14 below. The lower end of the bails 13*a* and 13*b* are connected to the ears 14*a* and 14*b* of the elevator 14. The hook 2, also suspends a guide plate 15 connected by a U-bolt 16, which is secured to the guide plate 15 with nuts 16*a* and 16*b*. The U-bolt 16 extends through apertures 15*c* and 15*d* in the guide plate 15. The bails 13*a* and 13*b* extend through two apertures 15*a* and 15*b* in the guide plate 15 such that horizontal movement of the bails 13*a* and 13*b*, the elevator 14, and the fill-up and circulating tool 46 is limited. A lock block 18 having a central axial bore is welded at one end to the bottom surface 15*e* of the guide plate 15. The lock block 18 includes at least one aperture 18*a* extending through the wall of the lock block 18 to receive spring pin 18*b*. Spring pin 18*b* is adapted to releasably extend through the lock block aperture 18*a* and to engage the channel 17*a* in the upper end of the bayonet adapter 17 on the fill-up and circulating tool 46. The spring pin 18*b* is inserted through the aperture 18 and into the channel 17*a* to retain the bayonet adapter 18 within the lock block 18 thereby suspending the fill-up and circulating tool 46 from the guide plate 15. To deliver fluid to the casing, the drilling fluid pump 8 is activated which discharges drilling fluid into hose 4, and into the fill-up and circulating tool through the nozzle 17*b* on the bayonet adapter 17, which transports the drilling fluid to the fill-up and circulating tool 46 and into the casing 32. Alternative embodiments of the lock block and bayonet adapter are contemplated by the present invention. For example, the lock block 18 comprise a cylinder with internal threads and the bayonet adapter with a male threaded end so as to be threadedly connected to the lock block. In a second alternative embodiment, the lock block 18 comprises a cylinder with two apertures extending through the wall of the cylinder 180° apart with the upper end of the bayonet adapter comprising a cylinder with two apertures extending through the wall of the cylinder 180° apart the cylinder having an outside diameter slightly smaller than the inside diameter of the lock block. The upper end of the bayonet adapter is inserted inside the lock block with the apertures in alignment. A pin would then be inserted through the apertures to retain the bayonet adapter and therefore the fill-up and circulation tool.

Figure 3:
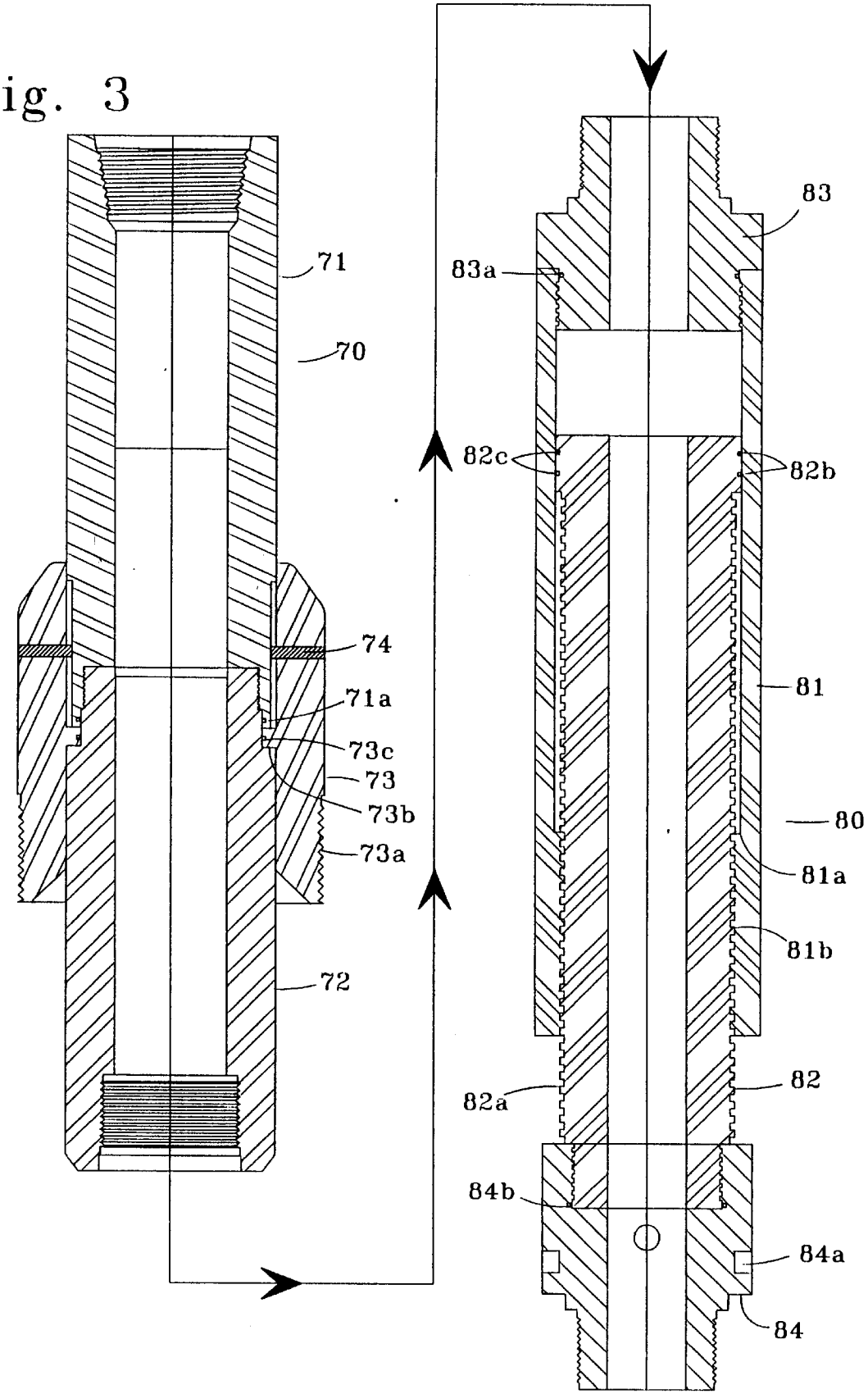
FIG. 3 Shows a side view of the torque sub and the adjustable extension.

FIG. 3 is illustrative of a torque sub 70 and a rotational sub 80, both or either of which may be used in combination with any fill-up and circulation tool insertable within a casing string in either a top drive or conventional rotary rig configuration. The torque sub 70, the operation and benefits of which are described above, includes three primary components, a top sub 71, a lock sub 72 and a thread adapter 73. The inlet of top sub 71 is threadedly connected to the top drive 3 (or rotary sub if a conventional rotary rig is used). The outlet of the top sub 71 is threadedly connected to the inlet of lock sub 72. The outlet of lock sub 72 may then be connected directly to the fill-up and circulation tool selected, or it may be connected to the adjustable extension 80. The outlet of top sub 71 also includes o-ring 71*a* which provides a fluid tight seal against the inlet of lock sub 72. Disposed about the lower outer surface of the top sub 71 and the upper outer surface of the lock sub 72 is thread adapter 73. The thread adapter 73 includes external threads 73*a*, which allows the assembly to be threadedly connected to the internal threads of a casing coupling. Thus, it will be obvious to one skilled in the art that the outside diameter of the thread adapter 73 varies with the inside diameter of the particular casing and therefore casing coupling used. Extending from the inside wall of the thread adapter is a shoulder 73*b*, which is in engaging contact with the outside wall on the outlet portion of the lock sub 72. Disposed within the shoulder 73*b* is a o-ring 73*c*, which provides a fluid tight seal between the thread adapter 73 and the lock sub 72. Extending laterally through the wall of the thread adapter 73, near its upper end, are pins 74. In the preferred embodiment, four (4) pins 74 are located approximately 90° apart. The pins 74 extend past the inside surface of the wall of the thread adapter 73 and extend through a slot 71*b* in the lower end of top sub 71 such that the end of the pins 74 engage against the wall of the top sub. This fixes the thread adapter 73 to the top sub 71. It will now be obvious that as the assembly is rotated by the top drive 3 (or rotary sub) to thread the thread adapter 73 into the casing coupling, the assembly rotates as a unitary structure. After the thread adapter 73 and casing coupling have been made-up, the elevator 14 and spider 10 may be released allowing the entire casing string to be rotated and/or reciprocated within the wellbore. Since the fill-up and circulation tool is still attached, fluid circulation may be performed as well.

FIG. 3 also shows the adjustable extension 80, the benefits and general operation of which is described above. The adjustable extension 80 allows a fill-up and circulation tool of any design to be extended and retracted automatically via the top drive 3 (or a rotary sub) or manually by simply rotating the adjustable extension 80 in the desired direction. The adjustable extension 80 may be used in place of or in addition to the top sub assembly or pup piece typically used to space the particular fill-up and circulation tool out on the rig. The adjustable extension 80 includes a lower adapter 84, a lower adapter 83, a screw mandrel 82, and a extension housing 81. The inlet of the upper adapter 83 includes threads to connect to a torque sub 70, a cement head assembly (see FIG. 5), or may be connected to the top drive or rotary rig. The outlet of the upper adapter 83 is threadedly connected to the upper end of extension housing 81. An o-ring 83*a* is disposed within the lower outer wall of the outlet of the upper adapter 80 to provide a fluid tight seal between the extension housing 81 and the upper adapter 83. The lower end of the extension housing 81 includes a shoulder 81*a*, after which threads 81*b* on the inside wall extend to the end of the extension housing 81. Threadedly connected to the lower end of the extension housing 81 is screw mandrel 82. The screw mandrel 82 includes threads 82*a* substantially along the length of the screw mandrel 82 so that when the extension assembly is rotated, the screw mandrel moves axially within the extension housing 81 allowing the tool to be extended or retracted as the need arises. The upper end of the screw mandrel 82 includes a flange 82*b*, the lower portion of which engages against the shoulder 81*a* of the extension housing 82 to create a stop when the extension assembly 80 is fully extended. The upper portion of the flange 82*b* engages against the outlet of the upper adapter 83 to create a stop when the extension assembly 80 is fully retracted. Disposed within the outer wall of the shoulder 81*a* are o-rings 82*c*, which provides a fluid tight seal between the screw mandrel 82 and the extension housing 81. Threadedly connected to the outlet of the screw mandrel 82 is the inlet of the lower adapter 84. Disposed within the inside wall of inlet of the lower adapter is an o-ring, which provides a fluid tight seal between the screw mandrel 82 and the lower adapter. The outlet of the lower adapter is threadedly connected to the fill-up and circulation tool, the cement head assembly 47, the torque sub 70 or other related assembly as the circumstances dictate. At least one slot 84*a* is disposed in the outer wall of the lower adapter 84. In order to retract or extend the adjustable extension 80, a bar or other suitable member is inserted into the slot and force is applied to the bar to extend or retract the adjustable extension 80 manually. In order to extend or retract the extension automatically, a bar or other suitable member of sufficient length to engage with the bails when rotated is inserted into the slot. Thus, it will be obvious to one skilled in the art that once the top drive 3 (or rotary sub) is activated to rotate, the bar will move along with the lower adapter 84 until the bar engages against the bail. Further rotation will cause the extension assembly 80 to be retracted or extended.

Figure 3A:
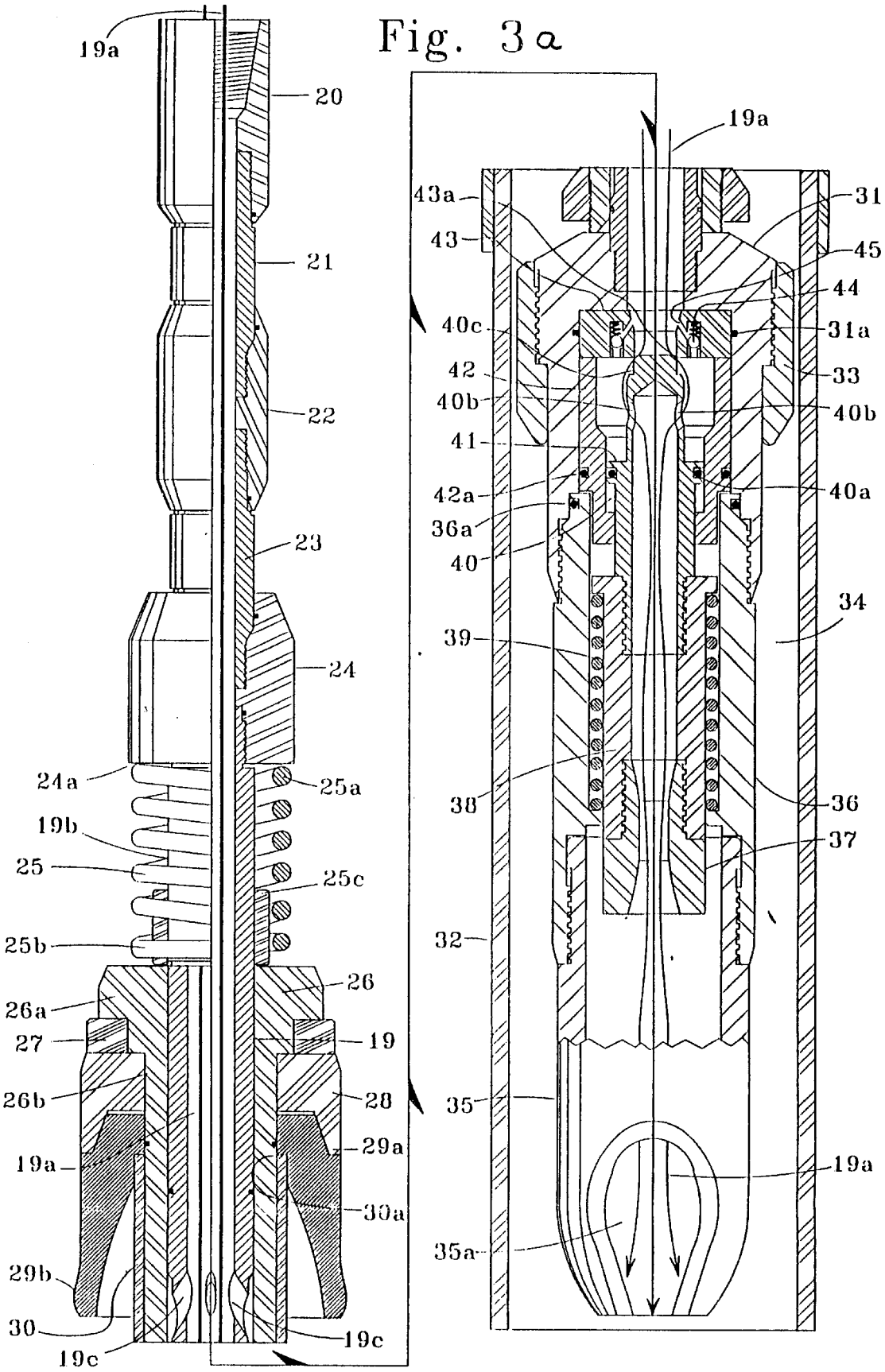
FIG. 3*a* Shows a side view of the fill up and circulating tool in the fill-up mode and configured for a top drive rig assembly.

FIG. 3*a* shows the preferred embodiment of the fill-up and circulating tool in the top drive configuration and in the fill up position. Those who are skilled in the art will know and understand that each component in the flow path includes an inlet and an outlet. The tool consists of a mandrel 19, having a central axial bore defining a flow path 19*a* through which fluid flows through the tool. A plurality of apertures 19*c* located near the outlet of the mandrel 19 allow fluid to flow through the apertures 19*c* during the circulating mode of the tool 46 as more fully described below. To lengthen the mandrel to space out the tool in any desired length on the rig, a top sub assembly is connected to the inlet of the mandrel 19. The top sub assembly consists of a top sub 20, a first spacer 21, a connector coupling 22, a second spacer 23, and a top collar 24 connected in series thereby extending the overall length of the tool as well as the flowpath 19*a*. Any number of couplings and spacers or length of spacer may be used to provide proper spacing on the top drive or conventional rotary rig configuration. Once the spacing requirements have been determined, the top sub assembly is configured with the top collar 24 connected to the inlet of the mandrel 19.

A spring 25 is disposed about the outer surface 19*b* of the mandrel 19. The upper end 25*a* of spring 25 is in engaging contact with and below lower surface 24*a* of top collar 24. A sliding sleeve 26 in engaging contact with the lower end 25*b* of the spring 25 is disposed about the outer surface 19*b* of the mandrel 19. A spring stop 25*c* is disposed within the annular space between the spring 25 and the outer surface 19*b* of the mandrel 19. The spring stop 25*c* is included to prevent the spring from being damaged from excessive compression. The spring 25 biases the sliding sleeve 26 such that in the fill-up mode of the tool 46, the sliding sleeve 26 covers the mandrel apertures 19*c*, which results in fluid flow exclusively through the outlet of the mandrel 19.

The upper end of the sliding sleeve 26 includes a flange portion 26*a*, the upper surface of which is In engaging contact with lower end 25*b* of the spring 25, and the lower surface of which is in engaging contact with a spacer ring 27. The lower surface of the spacer ring 27 is in engaging contact with a thimble 28. The thimble 28 is adapted to retain the upper end 29*a* of the sealing element, packer cup 29, against and between the lower surface of the thimble 28 and the outer surface of the sliding sleeve 26 near the upper end 26*b*. While packer cup 29 is shown as the preferred embodiment of the sealing element, any friction fit sealing device may be used, as well as other sealing devices such as inflatable packers and the like may be used in combination with the features and benefits of the sliding sleeve 26 and mandrel 19 described herein. The spacer ring 27 minimizes the potential for deflection of the thimble 28 when subjected to fluid pressure forcing the packer cup 29 and the thimble 28 upward and outward. A lock sleeve 30 is disposed about the sliding sleeve 26 and is connected to the lower end 26*b* of the sliding sleeve 26. The upper end 30*a* of the lock sleeve 30 is in engaging contact with the upper end 29*a* of the packer cup 29 to further retain the packer cup 29 within the thimble 28 and against the outer surface 26*b* of the sliding sleeve 26. The packer cup 29 depends downward with respect to the upper end 29*a* of the packer cup 29 flaring radially outward and away from the sliding sleeve 26 such that it forms a cone which defines an annular space between the inside surface of the packer cup 29 and the sliding sleeve 26. The outside diameter of the lower end 29*b* of the packer cup 29 is at least equal to the inside diameter of the casing 32. The lower end 29*b* is further adapted to be inserted into the casing and upon insertion to automatically engage with and to provide a leak tight seal against the inside diameter of the casing 32. The packer cup 29 is formed from a flexible elastomeric material such as rubber, however other materials or combination of materials are contemplated by the present invention. For example, in an alternative embodiment, the upper end 29*a* of the packer cup 29 is made of steel while the lower end 29*b* is made of rubber or some other elastomer.

The outlet of the mandrel 19 is connected to the inlet of a lower body 31. The lower body 31 limits the travel of the sliding sleeve 26 downward. In the fill-up mode of the tool 46, the spring 25 biases the sliding sleeve downward such that the bottom surface of the sliding sleeve 26 is in engaging contact with the top surface of the lower body 31. The lower body 31 also provides a conduit connection between the mandrel 19 and the mud saver valve 34. A guide ring 33 is connected to and disposed about the outer surface of the lower body 31. The guide ring 33 serves as a guide to center the tool 46 within the casing 32 as it is lowered. The outlet of the lower body 31 is threadedly connected to a mud-saver valve and nozzle assembly. The mud-saver valve and nozzle assembly includes a mud saver valve 34, and a nozzle 35. The preferred embodiment comprises a mud-saver valve 34 having threads on the outer surface of the valve inlet and internal threads on the inner surface of the valve outlet. The mud saver valve 34 is connected to the tool 46 by threadedly connecting the body extension 36 on the mud saver valve 34 to the inlet of the outlet of the lower body 31. In so doing, the body extension and a portion of the lower body 31 define the housing and annular space for the mud saver valve 34 internals. A body seal 36*a* comprising an o-ring is disposed within a channel formed in the outer surface of the upper end of the body extension 36 to seal against the inner surface of the lower body 31 outlet and the pressurized fluid from leaking at the connection. Beginning with the mud saver valve 34 internals at the outlet portion, a choke 37 is connected to a choke extension 38 for regulating the flow of fluid from the tool 46. The choke extension 38 and body extension 36 are adapted to retain a plunger spring 39 within the space defined by a portion of the inner surface of the body extension 36 and the outer surface of the choke extension 38. A plunger 40 having a central axial bore is connected to the upper end of the choke extension 40. The plunger 40 includes a centrally located protruding annular ring portion 41, which is in slidable engaging contact with the inner surface of a valve housing 42. A plunger seal 40*a* comprising an o-ring is disposed within a channel formed in the annular ring portion 41 to provide a leak tight seal against the valve housing 42. The upper end of the plunger 40 includes a plurality of apertures 40*b* to allow fluid to flow into the bore of the plunger 40 and out of the choke 37. A plunger tip 40*c* is adapted to provide a fluid tight seal against a plunger seat 43*a*. The plunger spring 39 biases the plunger 40 thereby exerting an upward force on the choke extension 40 and therefore the plunger 40 so that the plunger tip 40*c* engages with and provides a fluid tight seal against the plunger seat 43*a*. Fluid pressure exerted on the plunger tip 40*c* will cause the plunger spring 39 to depress, which creates an opening allowing fluid to flow through the mud saver valve 34 through the nozzle 35 and into the casing 32. The valve housing 42 is disposed between and is in engaging contact with the plunger 40 and the lower body 31. A housing seal 42*a* comprising an o-ring is disposed within a channel formed in the outer surface of the valve housing to provide a leak tight seal against the lower body 31. A seat ring 43 having a central axial bore is in engaging contact with and disposed within the uppermost interior portion of the lower body 31 and is in engaging contact with the valve housing 43 and the upper body 37. A lower body seal 31*a* comprising an o-ring is disposed within a channel formed in the lower body 31 to provide a leak tight seal against the seat ring 43. The outlet of a centrally located bore within the seat ring 43 defines the plunger seat 43*a*. The plunger seat 43*a* is adapted to sealingly receive the plunger tip 40*c*. The seat ring 43 further includes a plurality of spring loaded check valves 44 housed within vertical cavities 43*b*. An aperture 43*c* extends from each of the cavities 43*b* to provide fluid communication between the seat ring bore and the cavities 43*b*. When the pressure below the seat ring 43 exceeds the pressure above the seat ring 43, fluid will depressure through the check valves 44 and apertures 45 until an equilibrium pressure above and below the seat ring 43 is achieved. The check valves 44 therefore function as safety relief valves to ensure that high pressure fluid is not trapped below the tool, which could result in the tool 46 being expelled uncontrollably from the casing 32 as it is remove, or in a uncontrolled pressurized flow of fluid from the casing 32 when the tool is removed. It will be obvious to one skilled in the art that the uncontrolled depressurization of fluid could result in significant downtime due to loss of fluid, damage to equipment, and injury to personnel. The mud saver valve 34 also functions as a check valve to actuate open when the fluid pressure reaches a set point pressure of about 300 psig. As the fluid pressure increases above 300 psig, the plunger 40 is depressed against the spring 39 which lifts the plunger 40 from the plunger seat 43, which allows fluid to flow through the tool 46 and into the casing 32. When fluid pressure falls below about 300 psig the plunger spring 39 biases the plunger 40 upward causing the plunger tip to seat against the seat ring 43. Thus, the mud saver valve 34 retains fluid that would otherwise be drained and wasted from the tool 46. The nozzle 35 is connected to the outlet of the mud saver valve 34. The nozzle 35 is generally conical to facilitate insertion into the casing, and includes an aperture 35*a*, all of which allow fluid to escape from the tool 46 in a substantially laminar flow regime. Several mud saver valve 34 and nozzle 35 configurations are contemplated by the present invention. For example, a hose can be connected between the mud saver valve 34 and the nozzle 35, or a hose may be connected between the lower body 31 and the mud saver valve 34.

To begin the fluid filling process the fill-up and circulating tool 46 is lowered over the casing 32 to be filled. Only the portion of the tool 46 below the packer cup 29 is inserted into the casing 32. The packer cup 29 remains above and outside of the casing during the fill-up process. Fill-up of fluid is accomplished by simply activating the pump 8 to fill and then deactivating the pump 8 on completion. As the fluid pressure increases within the tool 46, the mud-saver valve plunger 40 is lifted from the plunger seat 43*a* and fluid is allowed to flow through the fill-up and circulating tool 46 and into the casing 32 to be filled.

Figure 4:
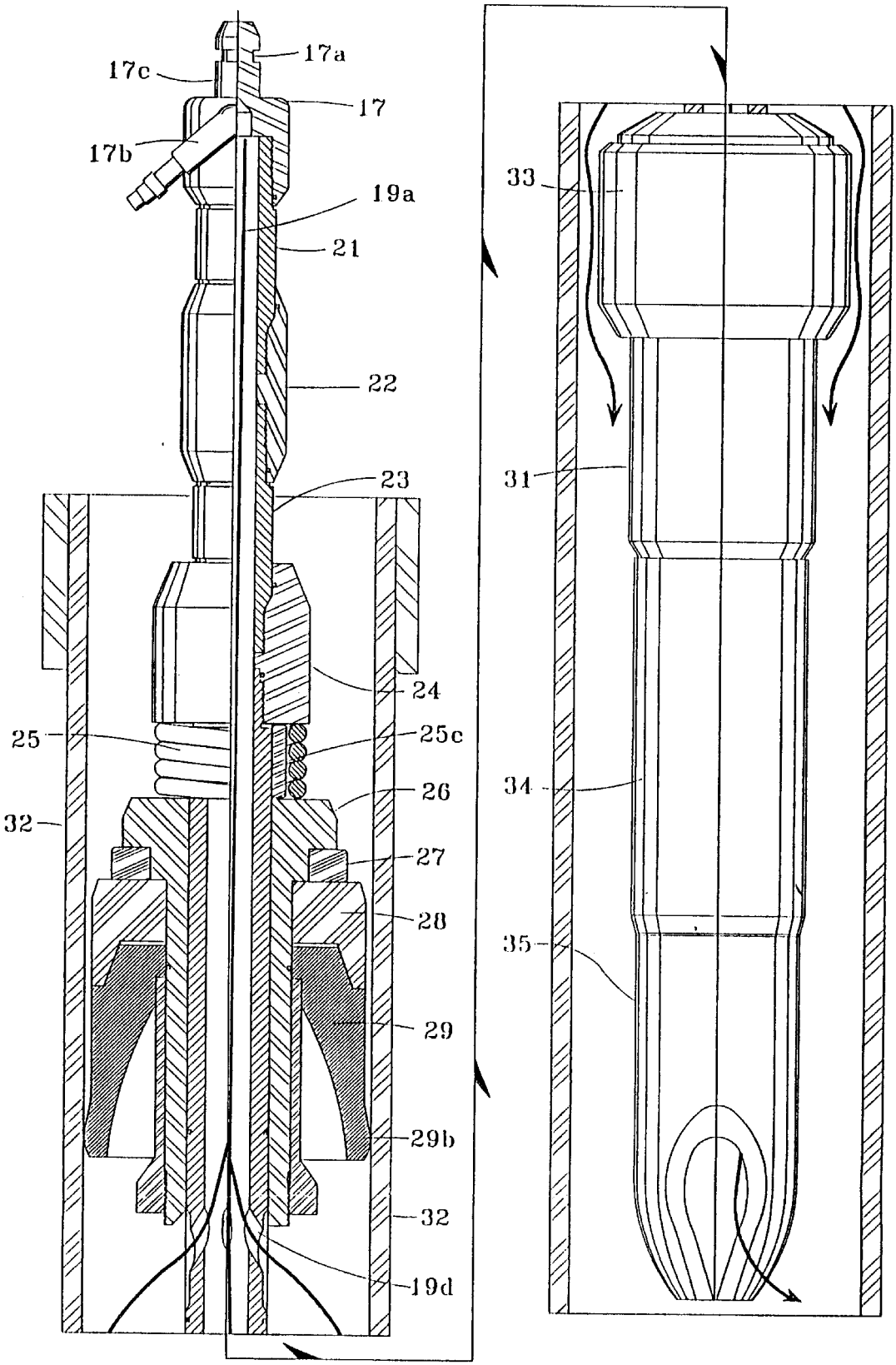
FIG. 4 Shows a side view of the fill up and circulating tool in the fill-up mode and configured for a conventional rotary rig assembly.

FIG. 4 shows the preferred embodiment of the fill-up and circulating tool in the rotary type configuration. FIG. 4 shows a bayonet adapter 17 connected to the first spacer 21 in place of the top sub 20 on the top sub assembly. If the top sub assembly is not needed, the bayonet adapter 17 may be connected directly to the mandrel. The bayonet adapter 17 includes a fluid hose connection 17*b*, adapted to connect to the fluid hose 4, and a cylindrical post 17*c* extending from the top of the bayonet adapter 17. The outside diameter of the post 17*c* is slightly smaller than the inside diameter of the lock block so that the post 17*c* may be inserted within the bore of the lock block 18. The outer surface of the upper end of the post 17 includes channel for receiving a spring pin, which allows the fill-up and circulation tool 46 to be suspended in the rotary rig configuration.

FIG. 4 also shows the fill-up and circulating tool 46 in the fluid circulation mode. The fill-up and circulating tool 46, in the rotary rig configuration, is shown lowered into the casing 32 such the packer cup 29 is in sealing engaging contact with the inside diameter of the casing 32. Flow of fluid from the pump 8 will cause the fluid pressure to build up inside of the casing 32 until the hydrostatic pressure is overcome thereby resulting in the desired circulation of fluid from inside the casing 32 into the wellbore 12. The packer cup 29 automatically engages against the inside diameter of the casing 32 as it is lowered therein. Therefore, when circulating within the casing is desired (e.g. when the casing is stuck in the wellbore 12), further downward force is exerted on the tool 47 by lowering the assembly from the traveling block 1. This causes the spring 25 disposed about the exterior of the mandrel 19 to become compressed between the top collar 24 and the flange portion 26*a* on the sliding sleeve 26. The downward force causes the mandrel 19 to move vertically downward with respect to the sliding sleeve 26 thereby exposing the lower end of the mandrel 19 and the apertures 19*c* therein. Pressurized fluid from the fluid pump 8 may now follow the flow path 19*a* through the tool 46 as well as through the apertures 19*c* into the casing 32. As the casing string 32 is filled, the fluid pressure inside of the casing increases, which further engages the packer cup 29 against the inside surface of the casing 32. When circulating is no longer necessary, the pump 8 is simply stopped. This results in the plunger 40 within the mud-saver valve 34 re-seating against the plunger seat 43*a*, which stops the flow of fluid from the nozzle 35. The tool 46 is then withdrawn from the casing 32 by raising the assembly suspended from the traveling block 1 so that the next joint of casing 32 can be picked up or to prepare the tool 46 for cementing operations.

Figure 5:
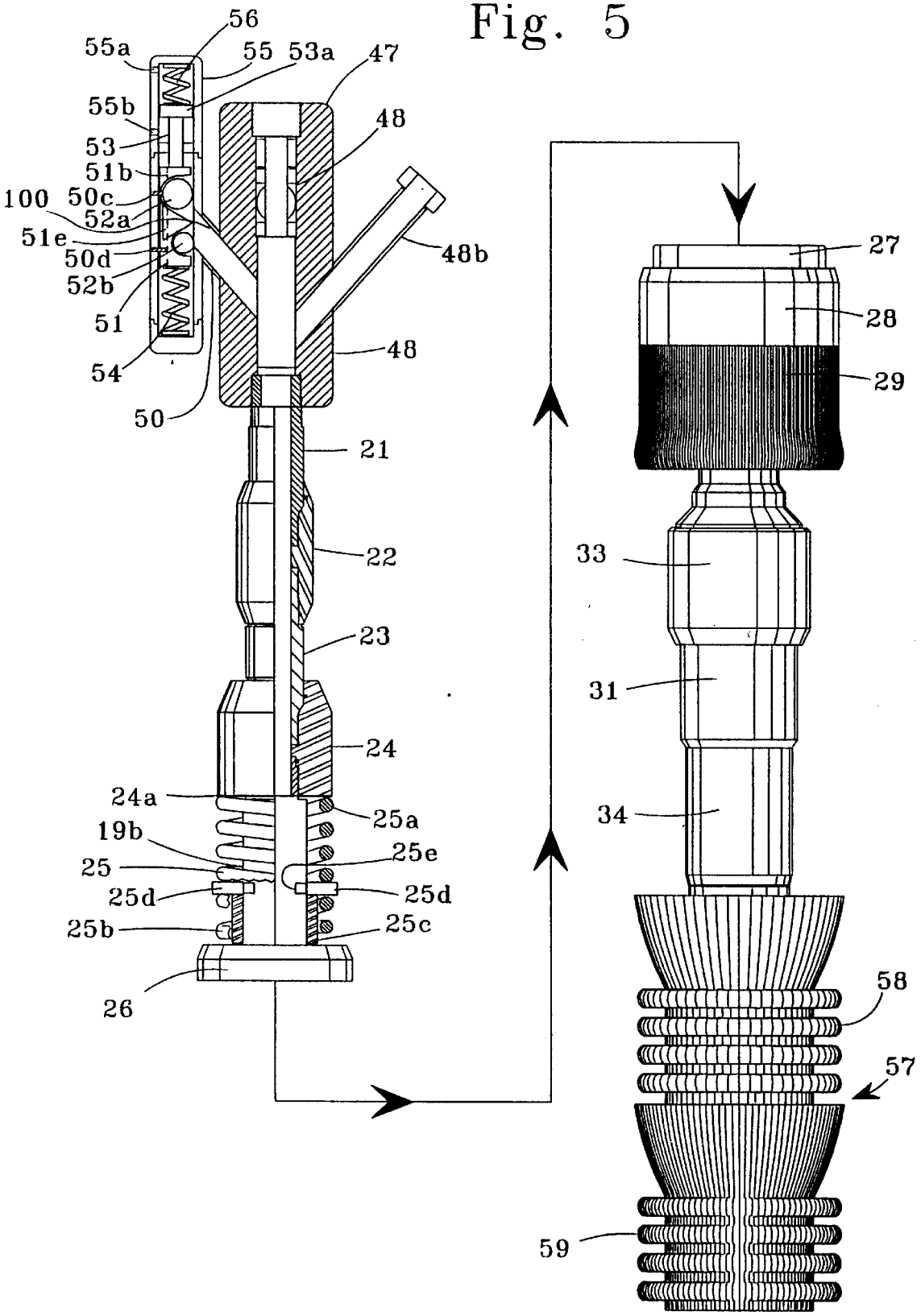
FIG. 5 Shows a side view of the fill up and circulating tool in the cementing mode and configured for a top drive rig assembly.

FIG. 5 illustrates the fill-up and circulating tool in the cementing configuration. While FIG. 5 shows the preferred embodiment of the fill-up and circulating tool shown in FIGS. 3 and 4, the present invention contemplates and includes fill-up and circulating tools of other embodiments. Thus, the discussion which follows whereby the fill-up and circulating tool 46 is referenced is for illustrative purposes. Further, this configuration may be utilized in either the top drive rig or conventional rotary rig assemblies. Any fill-up and circulating tool capable of insertion into casing may be quickly and easily switch from a drilling fluid filling and circulating mode of operation to the cementing configuration as shown in FIG. 5 by combining the selected fill-up and circulating tool with the cementing head assembly 47 and wiper plug assembly 57 of the present invention. The fill-up and circulating tool, in the cementing configuration, is connected to and therefore extends the flow path from a cementing head assembly 47 to a wiper plug assembly 57. Using the fill-up and circulating tool 46 as more fully described above, the cementing configuration comprises a cementing head assembly 47 connected to the first spacer 21 on the top sub assembly, and a cement wiper plug assembly 57 in place of the mud saver valve 34 and nozzle 35. Since the present invention contemplates and includes fill-up and circulating tools of various other embodiments, other means of attachment to the top drive or conventional rotary type units are contemplated as required by the particular fill-up and circulating tool used in the cementing configuration.

The preferred embodiment of the cement head assembly 47 includes a ball drop coupling 48, a ball carrier assembly 49, and a ball port 50 connecting the ball drop coupling 48 to the ball carrier assembly 49 providing a passageway therebetween. The ball carrier assembly 49 includes a ball carrier mandrel 51, which houses a ball carrier 51*a* in slidable engagement with the interior surface of the ball carrier mandrel 51. The lower surface of the ball carrier 51*a* includes a slot (not shown) within which ball stops 51*b* and 51*c* are disposed. The ball carrier 51*a* further includes a large ball seat and small ball seat within which a large ball 52*a* and a small ball 52*b* are respectively seated. Slidably disposed between the large ball seat and small ball seat within the ball carrier slot is ejector 51*d*. Attached to a upper surface of the ball carrier 51*a* is plunger 53 which extends through an aperture in the upper end of ball carrier mandrel 51. Disposed between a lower interior surface of ball carrier mandrel 51 and a lower surface of ball carrier 51*a* is ball spring 54. Threadedly connected to the upper end of ball carrier mandrel 51 is a pressure housing 55. The pressure housing 55 houses a upper end of the plunger 53 and a plunger spring 56. The plunger spring 56 is disposed between a top surface of the plunger head 53*a* and a inside surface on the top of the pressure housing 55. The plunger spring 56 biases the plunger 53 against the biasing force applied by the ball spring 54 so that in the neutral position designated by line 100, the ball carrier 51 is in a position that prevents the release of either of the balls 52*a* and 52*b* through the ball port 50 and into the ball drop coupling 48. The pressure housing 55 also includes pressure ports 55*a* and 55*b* through which a pressurization fluid (either gas (e.g. air) or hydraulic fluid) is delivered into the pressure housing 55. In the preferred embodiment the fluid pressure is supplied by air. Thus, the cement head assembly 47 may be actuated remotely to release the appropriate ball using fluid pressure. To release the large ball 52*a*, air pressure in the range of 90–120 psi is delivered to pressure port 55*a*. The fluid pressure forces the plunger 53 and the ball carrier 51 down to a position such that the movement of ejector 51*d* within the ball carrier slot stops on contact with stop 51*b* the contact of which results in large ball 52*a* being ejected through the ball port 50 and descends into the ball drop coupling 48. The pressure housing 55 may be depressured, which allows the spring biasing forces to overcome the fluid pressure returning the ball carrier 51*a* to the neutral position 100. To eject the small ball 52*b*, air pressure is delivered to pressure port 55*b*. The fluid pressure forces the plunger 53 and the ball carrier 51*a* upward to a position such that the movement of ejector 51*d* within the ball carrier slot stops on contact with stop 51*c* the contact of which results in small ball 52*b* being ejected through ball port 50 and descends into the ball drop coupling 48. Again, the pressure housing 55 may be depressured, which allows the spring biasing forces to overcome the fluid pressure returning the ball carrier 51 to the neutral position 100.

If the fill-up and circulating tool 46 (of FIG. 3*a* or 4) is installed with the cementing head assembly 47 and wiper plug assembly 57, it is preferable to keep cement from flowing through the mandrel apertures 19*c*. If cement is allowed to flow through the mandrel apertures 19*c*, plugging of the apertures as well as erosion may occur. To prevent this the sliding sleeve 26 must be fixed in place on the fill-up and circulating tool of the present invention so that the mandrel apertures 19*c* remain covered during the cementing operation. To accomplish this a set screw 25*d* is disposed within each of a plurality of threaded set screw apertures 27*b* in the outer surface 19*b* of the mandrel 19 near the mandrel outlet. Preferably the apertures are located a minimum distance above the spring stop 25*c* to fix the sliding sleeve 26 in a position to cover the mandrel apertures 19*c* during the cementing operations. Thus cement will not flow from the mandrel 19 through the mandrel apertures 19*c*. It is therefore desirable for the full flow of cement to follow flow path 19*a* so as to ensure proper operation of the ball dropping function, and to prevent plugging or erosion of the mandrel 19. One who is skilled in the art will readily perceive other methods for preventing the sliding sleeve 26 from moving upward to expose the mandrel apertures 19*c*. For example, a tubular member may be disposed about the spring 25 between the top collar 24 and the sliding sleeve 26 fix the sliding sleeve 26 in place.

After the casing string has been run, it must be cemented into the bottom of the wellbore 12. After the last casing joint has been filled with drilling fluid, a volume of water or flushing fluid is pumped through the assembly and into the casing. The assembly is then removed from the casing string to be configured for the cementing mode. The fill-up and circulating tool is then uncoupled from the top drive or rotary drive unit. The cementing head assembly 47 is coupled to the inlet of the tool. In the alternative, the cementing head assembly 47 may be pre-installed with the fill-up and circulating tool for operation in both the drilling fluid and cementing mode. The next step is to connect the wiper plug assembly 57 to the lower body 31 on the fill-up and circulating tool 46. First, the mud saver valve 34, and nozzle 35 are removed from the fill-up and circulating tool 46. The wiper plug assembly 57 is then installed. The wiper plug assembly 57 comprises a top wiper plug 58 detachably connected to a bottom wiper plug 59. The fill-up and circulating tool is now in the cementing configuration and is then reconnected to the top drive or rotary unit. The next step is to release the bottom plug 59 from the wiper plug assembly 57. To release the bottom plug 59, the first of two tripping balls 52*b* must be released from the ball carrier assembly 49. To release the tripping ball 52*b* fluid pressure is exerted against the plunger 53 lifting is upward, which allows the ball 52*b* to descend through the ball port 50 and into the tool 46. The small ball 52*b* severs the connection between the two wiper plugs 58 and 59, which causes the bottom wiper plug 59 to drop into the casing string 32. A calculated volume of cement is then pumped through nozzle 48*b* the tool and assembly, which drives the bottom wiper plug 59 down the casing string and ball valve 48*a* prevents fluid from flowing upward and out of the tool 46. As the bottom wiper plug 59 descends the casing string, it wipes mud off the inside diameter of the casing. The cement drives the bottom wiper plug 59 to engage with the float collar at the bottom of the casing 32. After the calculated volume of cement has been pumped, a second tripping ball is released from the cement head assembly 47. The large ball 52*a* severs the top plug 58 from the wiper plug assembly 57 and descends into the casing string. The top plug 58 is driven down the casing 32 by pumping drilling fluid or other suitable fluid behind the top plug 58, which also wipes the cement off the inside of the casing. When sufficient pressure is generated between the two wiper plugs 58 and 59, a diaphragm in the bottom wiper plug 59 is ruptured, which allows the cement between the wiper plugs 58 and 59 to flow from inside the casing 32 through the bottom wiper plug 59 and into the annulus 12. After the top plug 58 has come to rest by engaging against the bottom plug 59, the discharge pressure on the pump begins to increase, which indicates that the casing 32 has been successfully sealed off from the annulus 12.

The fill-up and circulation tool of the present invention may readily be used in a tandem configuration. The tandem configuration is used when it is desired to run two different diameter casing strings, and has the advantage of eliminating the downtime required to rig up prior art circulation tools. The tandem configuration embodiment comprises the fill-up and circulation tool as described above, however it includes a second sliding sleeve and packer cup arrangement connected above the first sliding sleeve and packer cup wherein the diameter of the second packer cup 29' is larger than the first packer cup 29. This allows for both the larger and smaller diameter casing to be filled and circulated without re-tooling. This arrangement can also be used with other sealing elements such as Inflatable packers, and devices that seal against the casing via and interference or friction fit with the casing.

Figure 6:
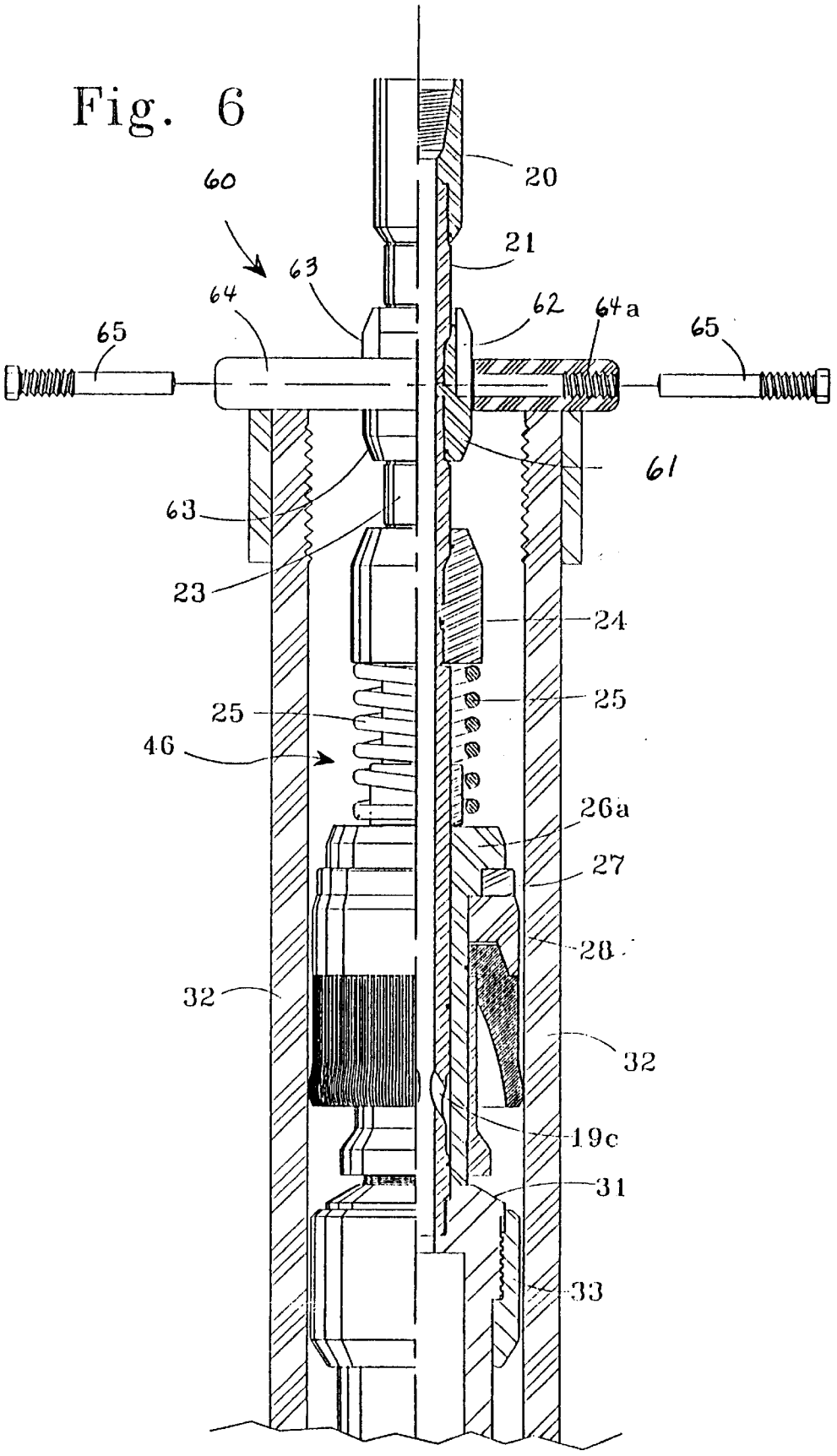
FIG. 6 Shows a side view of the fill up and circulating tool configured with the push plate assembly.

FIG. 6 is illustrative of a push plate assembly 60. During casing operations, it may be necessary to apply a downward force to push the casing 32 into the wellbore. This feature allows the weight of the rig assembly to be applied to the top of the casing through the push plate assembly 60. While FIG. 6 shows the preferred embodiment of the fill-up and circulating tool shown in FIG. 3, the present invention contemplates and includes fill-up and circulating tools of other embodiments. Thus, the discussion which follows whereby the fill-up and circulating tool 46 is referenced is for illustrative purposes. Further, this configuration may be utilized in either the top drive rig or conventional rotary rig assemblies. The push plate assembly 60 is located between the top collar 24 and the top sub 20 on the fill-up and circulating tool 46, and is installed in place of the standard connector coupling 22. The push plate assembly 60 includes a coupling 61 with a plurality of J shaped slots 62 within the outer wall 63 of the coupling 61. A rotatable plate 64 is radially disposed about the coupling 61 and is adapted to be fixed about the coupling 61 with a plurality of pins 65.

To add load to the casing string, the plate 64 must first be rotated until the pin 65 is engaged within the horizontal portion of the J-shaped slot 62. This locks the plate 64 within the assembly 60 so that load may then be transferred to the casing string. The spider 10 is then engaged against the casing 32 to hold the string in place. The elevator 14 is then released from the casing above the rig floor. The top drive unit 3 is then lowered by the traveling block 1 until the plate 64 is in contact with the top of the casing string. The elevator 14 is then attached to the casing 32. The spider 10 is then released. The casing 32 is now being held only by the elevator 14. Further lowering of the top drive unit 3, adds load (the weight of the rig) to the casing string, forcing the string into the wellbore 12. To disengage and release the load from the rig, the spider 10 is set against the casing to hold the casing string. The traveling block 1 is then raised about 6 inches to pick up on the top drive unit 3 enough to disengage the plate 64 from the top of the casing 32. The plate 64 is then rotated so that the pins 65 are aligned with the vertical portion of the J-shaped slot. The traveling block 1 is then lowered about 6 inches to push down on the top drive unit 3 enough to allow the elevator to be released from the casing string. The assembly can now be positioned to receive the next joint of casing 32 to be added to the string.

Those who are skilled in the art will readily perceive how to modify the present invention still further. For example, many connections illustrated have been show as threaded, however it should be understood that any coupling means (threads, welding, o-ring, etc.) which provides a leak tight connection may be used without varying from the subject matter of the invention disclosed herein. In addition, the subject matter of the present invention would not be considered limited to a particular material of construction. Therefore, many materials of construction are contemplated by the present invention including but not limited to metals, fiberglass, plastics as well as combinations and variations thereof. As many possible embodiments may be made of the present invention without departing from the scope thereof, it is to be understood that all matter herein set forth or shown in the accompanying drawings is to be interpreted as illustrative and not in a limiting sense. Accordingly, the foregoing description should also be regarded as only illustrative of the invention, whose full scope is measured by the following claims.

What is claimed is:

1. A fill-up and circulating tool for inserting into the upper end of a casing string to fill fluid into and to circulate fluid from inside the casing into a wellbore for use on top drive and rotary type drilling rigs, the fill-up and circulating tool comprising:

a mandrel having a central axial bore defining a flow path therethrough and a plurality of apertures;

a sliding sleeve in slidable engagement with and disposed about the mandrel for alternately covering and exposing the mandrel apertures;

an adjustable top sub assembly connected to the inlet of said mandrel for connecting the mandrel to the rig and variably extending the length thereon; and a sealing element fixedly connected to the sliding sleeve for sealing engagement with the inside diameter of the casing.

2. The fill-up and circulating tool of claim 1, wherein engagement of said sealing element with the inside diameter of the casing generally fixes the sliding sleeve in place with respect to said casing such that on sufficient downward movement of the mandrel said mandrel apertures are exposed from within said sliding sleeve.

3. The fill-up and circulating tool of claim 2 further comprising:

a spring disposed about the outer surface of said mandrel and retained between said top sub assembly and said sliding sleeve for biasing said sliding sleeve to cover the mandrel apertures;

a spring stop disposed between said spring and said mandrel to limit the compression of said spring; and a lower body connected to the mandrel outlet for limiting the travel of the sliding sleeve.

4. The fill-up and circulating tool of claim 3, further comprising a mud-saver valve connected to the lower body for controlling the flow of fluid through said mandrel.

5. The fill-up and circulating tool of claim 1, wherein said top sub assembly comprises a top sub, an adjustable extension, a first spacer, a connector coupling, a second spacer, and a top collar connected one to the other in series.

6. The fill-up and circulating tool of claim 1, wherein said adjustable top sub assembly comprises an adjustable extension.

7. The fill-up and circulating tool of claim 5, wherein said mandrel includes a plurality of set screw apertures and a set screw disposed therein, said set screws adapted to engage with the upper surface of the spring stop for fixing the sliding sleeve in position to cover said mandrel apertures.

8. The fill-up and circulating tool of claim 6, wherein said mandrel includes a plurality of set screw apertures and a set screw disposed therein, said set screws adapted to engage with the upper surface of the spring stop for fixing the sliding sleeve in position to cover said mandrel apertures.

9. The fill-up and circulating tool of claim 5, further comprising a cementing head assembly connected to the inlet of said mandrel.

10. The fill-up and circulating tool of claim 6, further comprising a cementing head assembly connected to the inlet of said mandrel.

11. The fill-up and circulating tool of claim 5, further comprising push plate means for transferring load forces to said casing to force the casing string into the wellbore.

12. The fill-up and circulating tool of claim 6, further comprising push plate means for transferring load forces to said casing to force the casing string into the wellbore.

13. An apparatus for inserting into the upper end of a casing string for wellbore casing cementing operations, the apparatus comprising:

a remote controlled cementing head assembly a fill-up and circulating tool having a central axial bore connected to said cementing head assembly; and a wiper plug assembly comprising a plurality of detachable wiper plugs connected to said fill-up and circulating tool for wiping the inside diameter of the casing and to seal the bottom of the casing string.

14. The apparatus of claim 13, wherein said wiper plug assembly comprises a top wiper plug detachably connected to a bottom wiper plug.

15. The apparatus of claim 12, wherein the ball dropping assembly comprises a ball drop coupling, a ball carrier assembly, and a ball port connecting the ball drop coupling to the ball carrier assembly.

16. The apparatus of claim 15, wherein the ball dropping assembly comprises a ball drop coupling, a ball carrier assembly, and a ball port connecting the ball drop coupling to the ball carrier assembly.

17. The apparatus of claim 16, wherein a plurality of tripping balls are is disposed within the ball carrier assembly.

18. The apparatus of claim 17, further comprising a extension assembly for retracting and extending the length of the fill-up and circulating tool.

19. The apparatus of claim 17, further comprising a top sub assembly for extending the flow path and adding length to said fill-up and circulating tool.

20. The apparatus of claim 17, further comprising a torque sub to allow the casing string to be rotated and reciprocated.

21. The apparatus of claim 17, further comprising a bayonet adapter connected to the cement head assembly for suspending said apparatus from a conventional rotary rig, said bayonet adapter adapted to allow fluid to be pumped therethrough and into said fill-up and circulation tool.

22. The apparatus of claim 20, further comprising push plate means for transferring load forces to said casing to force the casing string into the wellbore.

23. The apparatus of claim 21, further comprising push plate means for transferring load forces to said casing to force the casing string into the wellbore.

24. A fill-up and circulating apparatus suspended from a traveling block for filling fluid into casing, and circulating fluid through the inside surfaces of casing and into a wellbore, the fill-up and circulating apparatus comprising:

a fill-up and circulating tool;

an extension assembly connected to the fill-up and circulation tool for retracting and extending the length of the fill-up and circulating tool; and a rotary rig assembly capable of being raised and lowered from the traveling block for suspending the fill-up and circulating tool above the casing, the rotary rig assembly including a rotary sub.

25. The apparatus of claim 24, wherein the extension assembly comprises a upper adapter connected to a extension housing, said extension housing Threadedly connected to a screw mandrel, and a lower adapter connected to a outlet of said screw adapter.

26. The apparatus of claim 25, wherein said rotary rig assembly comprises a hook, a guide plate adapted to suspend a fill-up and circulating tool, a plurality of bails connected to the hook at one end and suspending an elevator at an opposite end, a rotary table, and a spider.

27. The fill-up and circulating tool of claim 26, wherein the fill-up and circulation tool includes a first and a second exterior sealing elements for sealing against the inside diameter of the casing in a tandem string.

28. The fill-up and circulating tool of claim 26, further comprising a mud-saver valve for controlling the flow of fluid from and depressurizing the fluid from the fill-up and circulation tool.

29. The fill-up and circulating tool of claim 26, further comprising a said top sub assembly, said top sub assembly comprising a top sub, a first spacer, a connector coupling, a second spacer, and a top collar.

30. The fill-up and circulating tool of claim 26, further comprising push plate means for transferring load forces to said casing to force the casing string into the wellbore.

31. The fill-up and circulating tool of claim 26, further comprising a torque sub to allow the casing string to be rotated and reciprocated.

32. A fill-up and circulating apparatus suspended from a traveling block for filling fluid into casing, and circulating fluid through the inside surfaces of casing and into a wellbore, the fill-up and circulator apparatus comprising:

a fill-up and circulating tool;

an extension assembly connected to the fill-up and circulation tool for retracting and extending the length of the fill-up and circulating tool; and a top drive rig assembly suspended from the traveling block, said top drive rig assembly including a top drive unit having a flow path therein, said top drive unit adapted to connect to the inlet of said fill-up and circulating tool, and adapted to align the fill-up and circulator assembly with the center of the casing.

33. The apparatus of claim 32, wherein the extension assembly comprises a upper adapter connected to a extension housing, said extension housing threadedly connected to a screw mandrel, and a lower adapter connected to a outlet of said screw adapter.

34. The apparatus of claim 33, wherein said top drive rig assembly comprises a hook, a top drive unit suspended from said hook, a plurality of bails connected to said top drive unit at one end and suspending an elevator at an opposite end, a rotary table, and a spider; wherein said top drive rig assembly is adapted to align the fill-up and circulation tool with the center of the casing.

35. The fill-up and circulating tool of claim 34, wherein the fill-up and circulation tool includes a first and a second exterior sealing elements for sealing against the inside diameter of the casing in a tandem string.

36. The fill-up and circulating tool of claim 34, further comprising a mud-saver valve for controlling the flow of fluid from and depressurizing the fluid from the fill-up and circulation tool.

37. The fill-up and circulating tool of claim 34, further comprising a said top sub assembly, said top sub assembly comprising a top sub, a first spacer, a connector coupling, a second spacer, and a top collar.

38. The fill-up and circulating tool of claim 34, further comprising push plate means for transferring load forces to said casing to force the casing string into the wellbore.

39. The fill-up and circulating tool of claim 34, further comprising a torque sub to allow the casing string to be rotated and reciprocated.

40. A torque sub assembly for attachment to a fill-up and circulation tool for rotating and reciprocating a casing string within a wellbore, the torque sub assembly comprising:

a top sub;

a lock sub connected to said top sub; and a thread adapter disposed about said top sub and said lock sub for engagement with a casing collar.

41. An adjustable extension for retracting and extending the length of a fill-up and circulation tool having at least two sealing elements, the adjustable extension comprising:

upper adapter;

a extension housing connected to the upper adaptor;

said extension housing threadedly connected to a screw mandrel; and a lower adapter connected to a outlet of said screw mandrel.

42. An improved method of filling and circulating fluid in wellbore casing suspended from a drilling rig floor, and cementing the casing string in the wellbore, the method comprising:

providing a top drive rig assembly comprising a top drive connected to at least one drilling fluid pump, an elevator, a rotary table, and a spider;

providing a fill-up and circulating tool adapted to be connected to the top drive and capable of being lowered into the casing;

providing a torque sub to allow the casing string to be rotated and reciprocated;

connecting said fill-up and circulating tool to said top drive;

lowering the top drive rig assembly such that the fill-up and circulating tool is positioned above the upper end of the casing suspended from the drilling rig floor;

thereafter pumping fluid to the top drive through the fill-up and circulating tool and into the casing string; and thereafter engaging the torque sub with a collar on the upper end of the casing string;

thereafter rotating said casing string with respect to the wellbore.

43. The method of claim 42, further comprising:

causing the fill-up and circulating tool to seal against the inside diameter of the casing to allow the drilling fluid to be circulated from inside the casing into the wellbore; and releasing the seal from the inside diameter of the casing and raising the fill-up and circulating tool out of and above the casing.

44. The method of claim 42, further comprising:

providing an adjustable extension for extending and retracting the fill-up and circulation tool; and extending the length of the fill-up and circulation tool.

45. An improved method of filling and circulating fluid in a wellbore casing suspended from a drilling rig floor, and cementing the casing in the wellbore, the method comprising;

providing a rotary rig assembly adapted to suspend a fill-up and circulating tool;

providing a fill-up and circulating tool adapted to seal with a upper end of the casing;

providing a torque sub to allow the casing string to be rotated and reciprocated; connecting said casing circulator with said torque sub forming an assembly and connecting said assembly to said rotary rig;

lowering the assembly such that the fill-up and circulating tool is positioned above the upper end of the casing string;

pumping drilling fluid through the assembly and into the casing string;

engaging the torque sub with a collar on the upper end of the casing string; and rotating said casing string with the wellbore.

46. The method of claim 45, further comprising:

the step of causing the fill-up and circulating tool to seal against the inside diameter of the casing to allow the drilling fluid to be circulated from inside the casing into the wellbore; and the step of releasing the seal from the inside diameter of the casing and raising the fill-up and circulating tool out of and above the casing.

47. The method of claim 45, further comprising:

providing an adjustable extension for extending and retracting the fill-up and circulation tool; and the step of extending the length of the fill-up and circulation tool.

* * * * *